United States Patent [19]

Blomqvist et al.

[11] 4,434,825

[45] Mar. 6, 1984

[54] FIREWOOD CLEAVING APPARATUS

[76] Inventors: Thomas H. Blomqvist, Sälgvägen 5, S-59300 Västervik; Thorbjörn G. Lidstöm, Ramnegärde PL 521, S-59400 Gamleby, both of Sweden

[21] Appl. No.: 326,394

[22] Filed: Dec. 1, 1981

[30] Foreign Application Priority Data

Dec. 12, 1980 [SE] Sweden ..... 8008770

[51] Int. Cl.[3] ..... B27L 7/00

[52] U.S. Cl. ..... 144/193 A; 144/193 E

[58] Field of Search ..... 144/193 A, 193 E, 193 R, 144/193 F

[56] References Cited

U.S. PATENT DOCUMENTS 4,353,401 10/1982 Schilling ..... 144/193 A

FOREIGN PATENT DOCUMENTS 2437917 6/1980 France ..... 144/193 E
222393 10/1967 Sweden .
380456 8/1973 U.S.S.R. ..... 144/193 A
414082 7/1974 U.S.S.R. ..... 144/193 A

*Primary Examiner*—W. D. Bray
*Attorney, Agent, or Firm*—Young & Thompson

[57] ABSTRACT

In accordance with the invention, a firewood cleaving apparatus comprises a number of cleaving irons situated in four different consecutive planes, so that a block of wood, which is forced down against the cleaving irons with the aid of a ram, will be stepwise split into twelve billets. The irons in the first two planes split the block in four pieces along radial lines. The iron in the third plane is annular and yields eight pieces; while the irons in the fourth plane are radial but cleave ony the radially outer pieces that were separated from the radially inner pieces by the annular cleaving iron.

5 Claims, 10 Drawing Figures

FIREWOOD CLEAVING APPARATUS

The present invention relates to a firewood cleaving apparatus of the kind including splitting or cleaving irons and a ram for forcing a wood block against the cleaving iron or cleaving irons thereby to divide the wood block into billets.

The most usual apparatus of this kind has only one cleaving iron which parts the block into two halves.

However, there is also an apparatus having two pairs of cleaving irons as shown in Swedish Pat. No. 222,393. The block is thereby divided into four substantially equal parts.

The known apparatus can to advantage be used for wood blocks with a relatively small diameter, i.e. such blocks as provide sufficiently small billets after having been divided into two or three pieces for enabling their use in wood stoves or open fireplaces.

When blocks with considerably greater diameter are contemplated, these must, using present apparatus first be divided into two or three parts, subsequent to which each of these parts is subjected to a repeated division. The disadvantage of the known apparatus is thus that it is difficult to provide a desired high-production capacity.

The object of the present invention is therefore to provide a firewood cleaving apparatus which makes it possible to force a wood block against cleaving irons arranged such that the wood block, during its passage through the apparatus, will be divided into a desired number of billets of a size such that they can be used without further cleavage.

This is achieved with a firewood cleaving apparatus which, in accordance with the invention, has a number of cleaving irons situated in four different planes, resulting in that cleavage for parting into billets takes place in steps, and thus the force of the ram can be considerably less than would be required for simultaneously executing all the cleavages. With the cleaving apparatus in accordance with the invention, it is thereby possible to cleave the block into twelve parts using relatively small force during the passage of the block through the cleaving apparatus.

Figures 5, 6, 7, 8, 9:
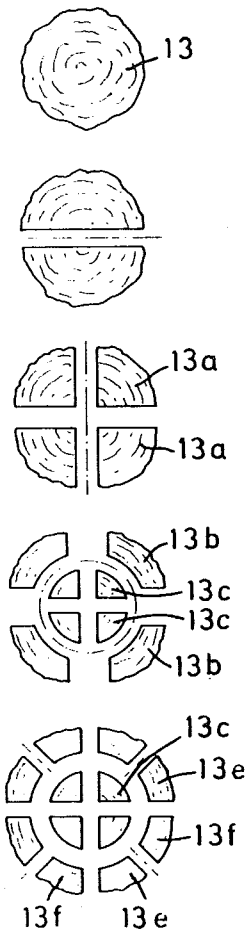
Figure 2A:
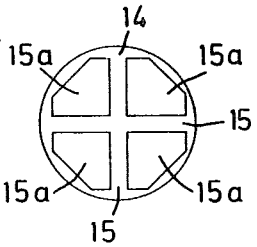
Figure 2:
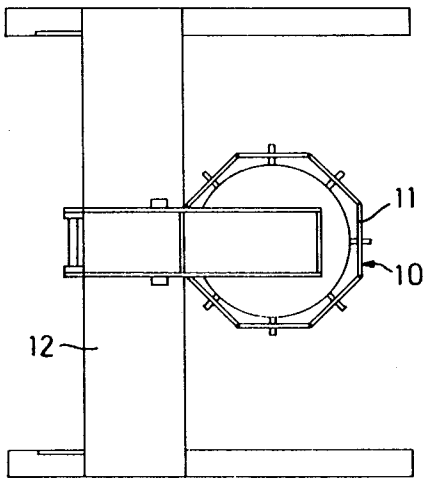
Figure 1:
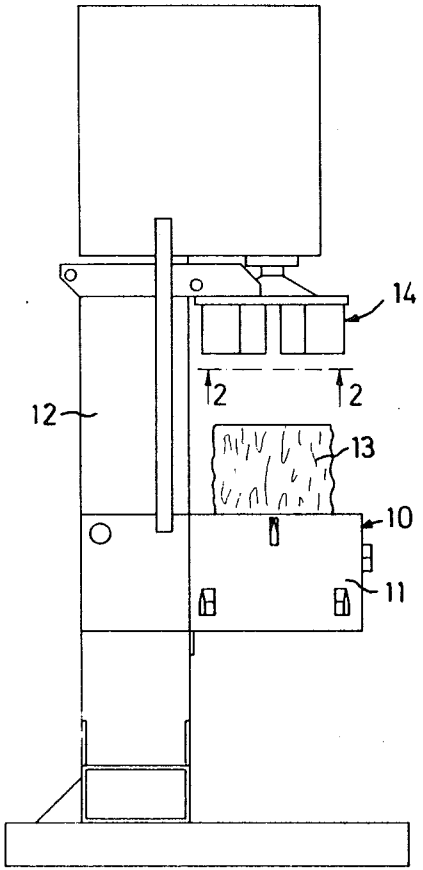
Figure 3:
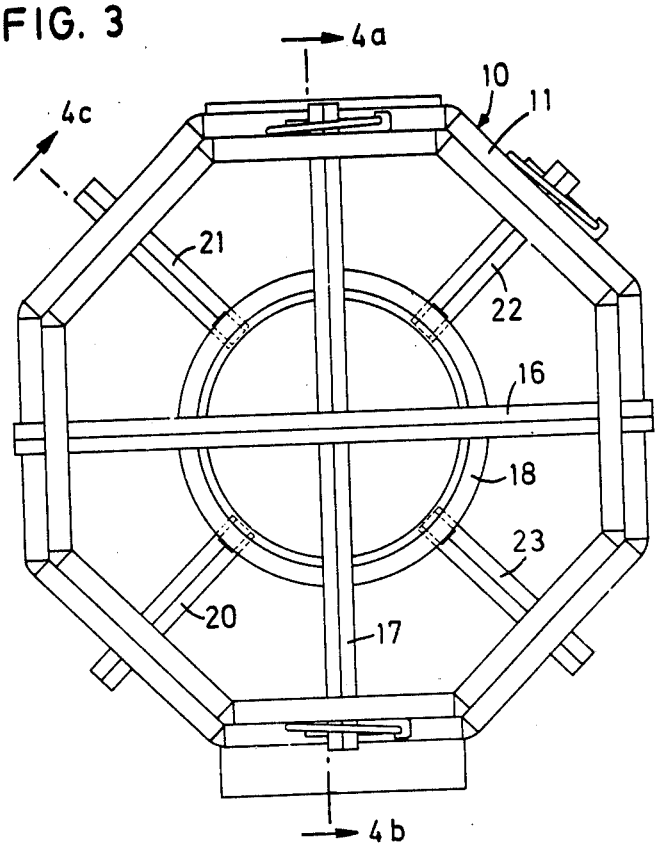
Figure 4:
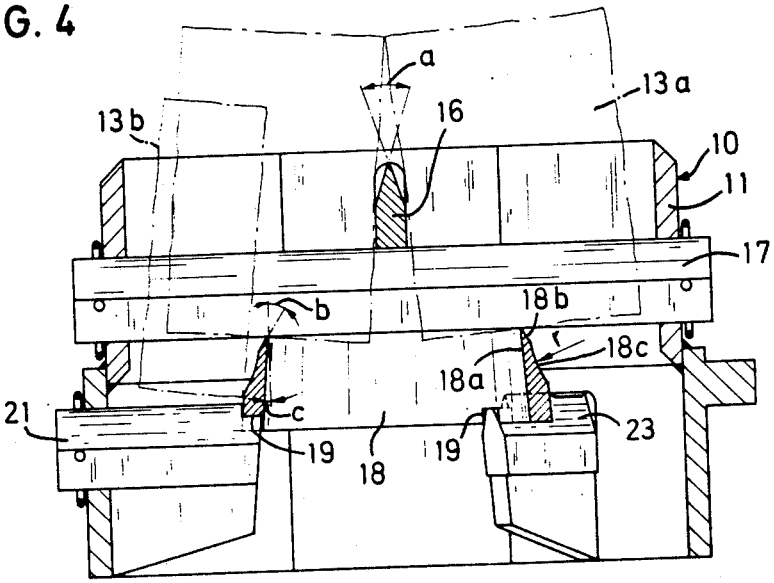

These and other distinguishing details and advantages of the invention will be explained in the following description of an example of a firewood cleaving apparatus in accordance with the invention, illustrated in the appended drawings, where FIG. 1 is a side view of an arrangement with a firewood cleaving apparatus in accordance with the invention, FIG. 2 is a view from above of the apparatus, FIG. 2A is a view from below of the ram along the line 2—2 in FIG. 1, FIG. 3 is a view from above of the inventive firewood cleaving apparatus with cleaving irons, FIG. 4 is a collection of different cross sections through the apparatus in FIG. 3 along the lines **4*a*–4*b* for the two uppermost intersecting cleaving irons and along the lines 4*c*–4*b* for the two bottom cleaving irons, namely an annular cleaving iron and a cleaving iron consisting of four radial arms, FIG. 5 illustrates the block seen from above, and FIGS. 6 to 9** schematically illustrate the different steps in cleaving the block with the respective cleaving iron which is indicated by chain-dotted lines in the respective figure.

The firewood cleaving apparatus 10 in FIGS. 3 and 4 comprises an octagonal frame 11 which is attached to the frame 12 of the apparatus, as shown in FIGS. 1 and 2.

As indicated in FIG. 1, a block 13 is intended to be placed on top of the apparatus 10 under a ram 14 which may be driven with the aid of a hydraulic means in the example shown.

The ram is provided with grooves 15 according to FIG. 2A to divide it into four pillars **15*a*** which can then go free of the two uppermost cleaving irons.

The cleaving irons have their edges situated in consecutive planes at right angles to the direction of motion of the ram.

In the first plane there is a first straight cleaving iron 16 extending diametrically and having its ends removably attached in openings in the opposing sides of the frame.

In the second plane there is a second straight cleaving iron 17 which is placed at right angles to the first cleaving iron and having its ends removably attached in openings in the opposing sides of the frame.

In a third plane the edges of a third cleaving iron lie in the form of an annular cleaving iron 18 having in its bottom edge four evenly distributed recesses 19 for carrying the annular cleaving iron on the inner ends of four radial arms 20,21,22,23. The outer ends of the arms are removably attached in openings in the frame, as will be apparent from FIG. 4.

The upper edges of the radial arms are formed as cutting edges, so that the arms form a fourth cleaving iron divided into four edges situated in a fourth plane.

The four pillars **15*a* of the ram can be freely displaced down into the vicinity of the edge of the annular cleaving iron 18**.

The block can be located on the cleaving apparatus with the aid of different means which are not shown. In some cases it can be held by a gripping means which releases the block when the ram begins to press it down. The upper end of the apparatus may also have a number of horizontal flaps which are lowerable against the bias of springs when the block begins to be pressed down towards the cutting irons.

In a first operation, the cleavage of the block is begun by the first cleaving iron 16, so that the greater portion of the block is split when its bottom end meets the second cleaving iron 17, which gradually splits the block halves to quarters. These will be further advanced in somewhat diverging directions until they meet the edges of the annular cleaving iron 18, which divides each fourth into an inner sector-shaped billet and an outer arcuate piece. The sector-shaped billets pass freely down through the ring while the outer arcuate pieces each meet one of the radial cleaving irons 20,21, 22,23 and is parted into two halves by it.

When the ram arrives at its bottom position, the halves of the arcuate pieces can in some cases remain with their upper ends outside the annular cleaving iron, but when the next block is forced down, portions of it will thrust out the billets in front of them.

As will be seen from FIG. 4, the cutting edges of the cleaving irons have certain angles, so that the irons will split the block with the least possible risk of the edges cutting obliquely into the grain thereof but follow the grain as far as possible, resulting in less force on the block for splitting it.

The first pair of cleaving irons 16,17 should each have a cutting edge angle a in the area of 30°–40°, the best result having been achieved at about 36°. The block is then split into four parts 13*a* which diverge and have the somewhat obliquely directed position indicated by chain-dotted lines in FIG. 4, when the lower ends of these parts meet the annular cleaving iron 18.

In the illustrated example, the cleaving iron 18 is a circular ring, but it can also have a polygonol configuration.

The upper edge of the annular cleaving iron 18 is ground to an edge angle b in the area of 25°–35°, the best value having been found to be about 30°. The inner side of the sharp edge of the annular cleaving iron 18*a* coincides with the inside of the annular cleaving iron, which widens conically with a small clearance angle c. This angle should be in the area of 2°–4°, which corresponds to a conical angle of 4°–8°, the best result having been achieved with a clearance angle of about 3°, i.e. a cone angle of about 6°.

The sharp edge of the annular cleaving iron 18 has an outer side including a flat, relatively short area 18*b*, after which it merges into a concave surface 18*c* having a radius r, and which is several times longer than the outer side 18*b* of the sharp edge and has a main direction forming an angle to the inside of the ring which is less than the edge angle b, as will be seen from FIG. 4. This results in that the edge has an obliquely upwardly directed direction substantially coinciding with the direction of the quarters 13*a* obtained by the cleaving irons when they meet the edge of the annular cleaving iron. The edge of the annular cleaving iron will thus engage with these quarters 13*a* substantially in their longitudinal direction with small risk of the edge cutting obliquely into the grain thereof. The ends of the wood pieces 13*b* thereafter glide down with their lower edges along the concave surface 18*c* and are urged outwardly by it to obtain a desired cleavage. By this embodiment of the annular cleaving iron, it is avoided that the wood pieces 13*b* are subjected to unnecessarily great frictional resistance against the outside of the annular cleaving iron 18, as well as avoiding that the edges cut into the fibres. Instead the edges will substantially follow the longitudinal direction of the fibres to cleave the pieces of wood with the least possible expenditure of force.

The edge angle of the last cutting irons 20,21,22,23 is less critical, but for manufacturing reasons it is in the same area as for the irons 16,17, i.e. about 36°.

As will be seen from the above, the construction of the firewood cleaving apparatus in accordance with the invention is extremely simple and thereby cheap. All the cleaving irons are easily exchangeable as required.

Practically executed tests show that the apparatus in accordance with the invention functions most satisfactorily and can, in combination with effective means for supplying wood blocks thereto, achieve a production capacity which has not been possible so far, and with the aid of a relatively small power requirement.

What we claim is:

1. In a firewood cleaving apparatus having a number of cleaving irons and a ram for pushing a wood block against the cleaving irons in order to divide the block into billets, the cleaving irons being arranged with their sharp edges in a number of axially spaced planes disposed at right angles to the direction of motion of the ram, a first cleaving iron having its sharp edge disposed in a first plane to begin the division of the block into two parts or halves and a second cleaving iron having its sharp edge disposed in a second plane to begin the division of the respective part of the two parts into further two parts or quarter parts so as to obtain four parts of the block; the improvement in which there is disposed in a third plane the sharp edge of an annular cleaving iron concentric with the central axis of the apparatus and adapted to begin the division of each quarter part into a radially inner part and a radially outer part, and there are disposed in a fourth plane the sharp edges of four radially directed cleaving irons adapted to begin division of each of only the radially outer parts but not the radially inner parts, into two further halves, whereby the block of wood thus is subdivided into twelve billets during its passage through the apparatus.

2. An apparatus as claimed in claim 1, in which the edges of the cleaving irons at the first and second planes, respectively, have an edge angle of about 30°–40°.

3. An apparatus as claimed in claim 1, characterized in that the cutting edge of the annular cleaving iron in the third plane has an edge angle of about 25°–35°, the inside of the annular cutting edge substantially coinciding with the inside of the annular cleaving iron, and the inside of the annular cleaving iron widening conically with a cone angle of about 4°–8°, so that the clearance on the inside of the edge is about 2°–4°.

4. An apparatus as claimed in claim 3, in which the outer side of the annular cleaving iron has a relatively short and substantially flat outer side, the lower end of which merges into a concave portion with less slope than the outer side of the edge and having a length which is several times greater than the outer side of the edge.

5. An apparatus as claimed in claim 1, in which the straight cleaving irons are arranged in an annular frame and are removably attached in openings in the sides of the frame, the annular cleaving iron resting on four evenly distributed radial cleaving irons having their outer ends removably attached in openings in the frame and coacting at their inner ends with recesses in the lower edge of the annular cleaving iron in order to keep this cleaving iron in position between the second cleaving iron and the radial cleaving irons.

* * * * *